US009498959B2

(12) United States Patent
Shinoto et al.

(10) Patent No.: US 9,498,959 B2
(45) Date of Patent: Nov. 22, 2016

(54) MAINTENANCE UNIT AND LIQUID EJECTION DEVICE

(71) Applicant: SEIKO EPSON CORPORATION, Tokyo (JP)

(72) Inventors: Akira Shinoto, Matsumoto (JP); Keiichiro Yoshino, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/930,108

(22) Filed: Nov. 2, 2015

(65) Prior Publication Data

US 2016/0121614 A1 May 5, 2016

(30) Foreign Application Priority Data

Nov. 5, 2014 (JP) ..... 2014-225403

(51) Int. Cl.
*B41J 2/165* (2006.01)

(52) U.S. Cl.
CPC ..... *B41J 2/16535* (2013.01); *B41J 2002/1655* (2013.01); *B41J 2002/16558* (2013.01)

(58) Field of Classification Search
CPC ..... B41J 2002/1655; B41J 2002/16591; B41J 2002/16573; B41J 2/165
See application file for complete search history.

(56) References Cited

U.S. PATENT DOCUMENTS 6,176,575 B1 * 1/2001 Crawford ..... B41J 2/0057 347/103
2002/0075344 A1 6/2002 Usui et al.
2005/0134666 A1 6/2005 Rousseau
2008/0252685 A1 * 10/2008 Gomez ..... B41J 2/16526 347/33
2013/0120495 A1 5/2013 Nakamura et al.
2014/0132667 A1 5/2014 Shinoto et al.
2014/0152740 A1 6/2014 Yoshino et al.

FOREIGN PATENT DOCUMENTS

| | | |
|---|---|---|
| EP | 1080912 | 3/2001 |
| EP | 2738004 | 6/2014 |
| EP | 2915671 | 9/2015 |
| JP | H08-323999 | 12/1996 |
| JP | H09-024625 | 1/1997 |
| JP | 2001-071533 | 3/2001 |
| JP | 2002-086744 | 3/2002 |
| JP | 2002-225307 | 8/2002 |
| JP | 2005-138479 | 6/2005 |
| JP | 2005-178387 | 7/2005 |
| JP | 2005-212351 | 8/2005 |
| JP | 2007-185795 | 7/2007 |
| JP | 2009-023358 | 2/2009 |
| JP | 2013-103379 | 5/2013 |
| JP | 2014-087991 | 5/2014 |
| JP | 2014-094542 | 5/2014 |
| JP | 2014-108523 | 6/2014 |
| JP | 2014-108594 | 6/2014 |

* cited by examiner

*Primary Examiner* — Geoffrey Mruk
(74) *Attorney, Agent, or Firm* — Workman Nydegger

(57) ABSTRACT

A maintenance unit mounted in a removable manner in a liquid ejector that ejects liquid. The maintenance unit includes an elongated maintenance member, which is used to perform maintenance on the liquid ejector, and a memory, which is configured to store information related to the maintenance member.

12 Claims, 4 Drawing Sheets

MAINTENANCE UNIT AND LIQUID EJECTION DEVICE

CROSS REFERENCE TO RELATED APPLICATIONS

The entire disclosure of Japanese Patent Application No. 2014-225403, filed on Nov. 5, 2014, is expressly incorporated by reference herein.

BACKGROUND

1. Technical Field

The present invention relates to a maintenance unit used to perform maintenance on a liquid ejector and to a liquid ejection device, such as a printer, to which the maintenance unit is attached in a removable manner.

2. Related Art

One example of a liquid ejection device is an inkjet printer that includes a liquid ejection head, which ejects ink for printing, and a wiper holder, to which a wiper cassette is attached in a removable manner. The wiper cassette includes an elongated wiping member that wipes off liquid from the liquid ejection head.

The wiping member, which is accommodated in the wiper cassette, includes two ends that are each wound around a reel. Rotation of the two reels unwinds the wiping member from one reel and winds the wiping member around the other reel. The two reels are rotated to arrange an unused portion of the wiping member between the two reels and wipe the liquid ejection head with the unused portion (e.g., JP-A-2013-103379).

In a wiper cassette such as that described above, when the wiping member has been completely unwound from one reel and runs out of the unused portion, maintenance can no longer be performed on the liquid ejection head. Thus, when the remainder of the wiping member is not checked and the wiping member runs out of the unused portion during a maintenance operation, maintenance may end incomplete.

This problem is not limited to a wiping member that wipes ink off an ink ejection head and also occurs when performing maintenance on a liquid ejector using a maintenance member that has a limit to the usable amount or a usage expiration date.

SUMMARY

An advantage of some aspects of the invention is in that a maintenance unit and a liquid ejection device are provided that properly manage a maintenance member used to perform maintenance on a liquid ejector.

Means for solving the above problem and the effects of the means will now be described.

A maintenance unit that solves the above problem is mounted in a removable manner in a liquid ejection device including a liquid ejector that ejects liquid. The maintenance unit includes an elongated maintenance member, which is used to perform maintenance on the liquid ejector, and a memory, which is configured to store information related to the maintenance member.

In this configuration, the memory of the maintenance unit stores information related to the maintenance member. Thus, management may be properly performed on the maintenance member, which is used to perform maintenance on the liquid ejector, based on the information stored in the memory.

In the maintenance unit, the memory is configured to store a value corresponding to the number of times maintenance has been performed with the maintenance member.

In this configuration, the used amount of the maintenance member may be estimated based on the value corresponding to the number of times maintenance has been performed with the maintenance member stored in the memory to properly perform management of the maintenance member, while managing the remainder of the maintenance member.

In the maintenance unit, the memory is configured to store a value corresponding to an amount the maintenance member has been moved to perform maintenance on the liquid ejector.

In this configuration, the used amount of the maintenance member may be estimated based on the value corresponding to the moved amount of the maintenance member stored in the memory. Thus, for example, even if the maintenance unit, which is being used, is mounted in a different liquid ejection device, cumulation of the used amount of the maintenance member allows for accurate management of the remainder of the maintenance member.

In the maintenance unit, the memory is configured to store information related to the liquid ejection device in which the maintenance unit has been mounted.

In this configuration, the memory stores information related to the liquid ejection device in which the maintenance unit has been mounted. Thus, for example, even if the maintenance unit, which is being used, is mounted in a different liquid ejection device, it would be acknowledged whether or not the maintenance unit has ever been mounted in that liquid ejection device.

In the maintenance unit, the memory is configured to store information related to the date the maintenance unit was mounted in the liquid ejection device.

In this configuration, the memory stores information related to a date the maintenance unit was mounted in the liquid ejection device. Thus, when the maintenance member has an expiration date, maintenance may be properly performed on the liquid ejector, while managing the expiration date.

In the maintenance unit, the memory is configured to store information related to a manufacturing date of the maintenance unit.

In this configuration, the memory stores information related to the manufacturing date of the maintenance unit. Thus, when the maintenance member has an expiration date, maintenance may be properly performed on the liquid ejector, while managing the expiration date.

In the maintenance unit, the memory is configured to store information related to the liquid ejection device in which the maintenance unit is mountable.

In this configuration, when there is a maintenance member that is suitable for use with a certain liquid ejector and a maintenance member that is not suitable for use with the certain liquid ejector, the information stored in the memory and related to the liquid ejection device in which the maintenance unit is mountable may be referred to in order to avoid a situation in which the unsuitable maintenance member performs maintenance on the liquid ejector.

In the maintenance unit, the memory is configured to store information related to liquid with which the maintenance unit is impregnated.

When there is an impregnated liquid that is suitable for use with a certain liquid ejector and an impregnated liquid that is not suitable for use with the certain liquid ejector, the information stored in the memory and related to the impregnated liquid of the maintenance member 21 may be referred to in order to avoid a situation in which a maintenance member impregnated with the unsuitable liquid performs maintenance on the liquid ejector.

The maintenance unit further includes a holding structure, which holds the maintenance member in a movable manner, and a case, which accommodates the holding structure.

A liquid ejection device that solves the above problem includes a liquid ejector that ejects liquid, a mount in which the maintenance unit is mounted in a removable manner to perform maintenance on the liquid ejector, and a control unit configured to perform a maintenance operation on the liquid ejector based on information stored in the maintenance unit.

This configuration has the same advantages as the maintenance unit.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF EXEMPLARY EMBODIMENTS

One embodiment of a maintenance unit and a liquid ejection device will now be described with reference to the drawings. The liquid ejection device is an inkjet printer that ejects ink, which is one example of a liquid, onto a medium such as paper to perform recording (printing).

Figure 1:
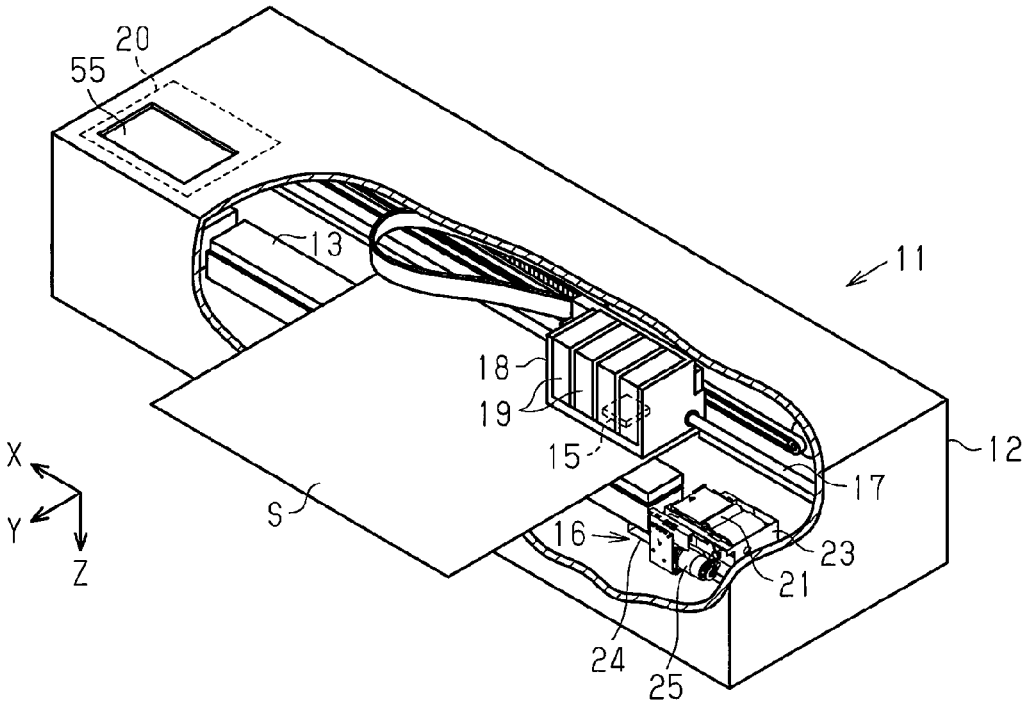
FIG. 1 is a schematic perspective view showing one embodiment of a liquid ejection device.

As shown in FIG. 1, a liquid ejection device 11 includes a housing 12, a medium support 13, a liquid ejector 15, and a maintenance device 16. The medium support 13 supports a medium S in the housing 12. The liquid ejector 15 includes nozzles 14 (refer to FIG. 2) from which liquid can be ejected onto the medium S supported by the medium support 13. The maintenance device 16 is used to perform maintenance on the liquid ejector 15. A display such as a liquid crystal display is arranged in the outer surface of the housing 12.

Further, the liquid ejection device 11 includes a control unit 20, which may be located at any position in the housing 12 and controls the liquid ejector 15 and the maintenance device 16. Under the control of the control unit 20, the liquid ejector 15 ejects liquid in an ejection direction Z from the nozzles 14 onto the medium S, which is fed in a feed direction Y on the medium support 13, to perform recording (printing).

A carriage 18, which holds the liquid ejector 15, moves back and forth along a guide 17, which extends in a movement direction X. One or more liquid containers 19, each containing a liquid that is supplied to the liquid ejector 15, are attached in a removable manner to the carriage 18. The movement direction X, the feed direction Y, and the ejection direction Z intersect one another (preferably at right angles). In the present embodiment, the ejection direction Z intersects the horizontal direction. Thus, the ejection direction Z defines the downward direction, and the opposite direction defines the upward direction.

In the housing 12, the region in which the medium support 13 is located is referred to as the ejection region, and the region in which the maintenance device 16 is located is referred to as the maintenance region. The maintenance region is located next to the ejection region in the movement direction X and at the outer side (right side in FIG. 1) of the ejection region. In the present embodiment, the movement direction X extends from the maintenance region toward the ejection region.

The structure of the maintenance device 16 will now be described in detail.

Figure 2:
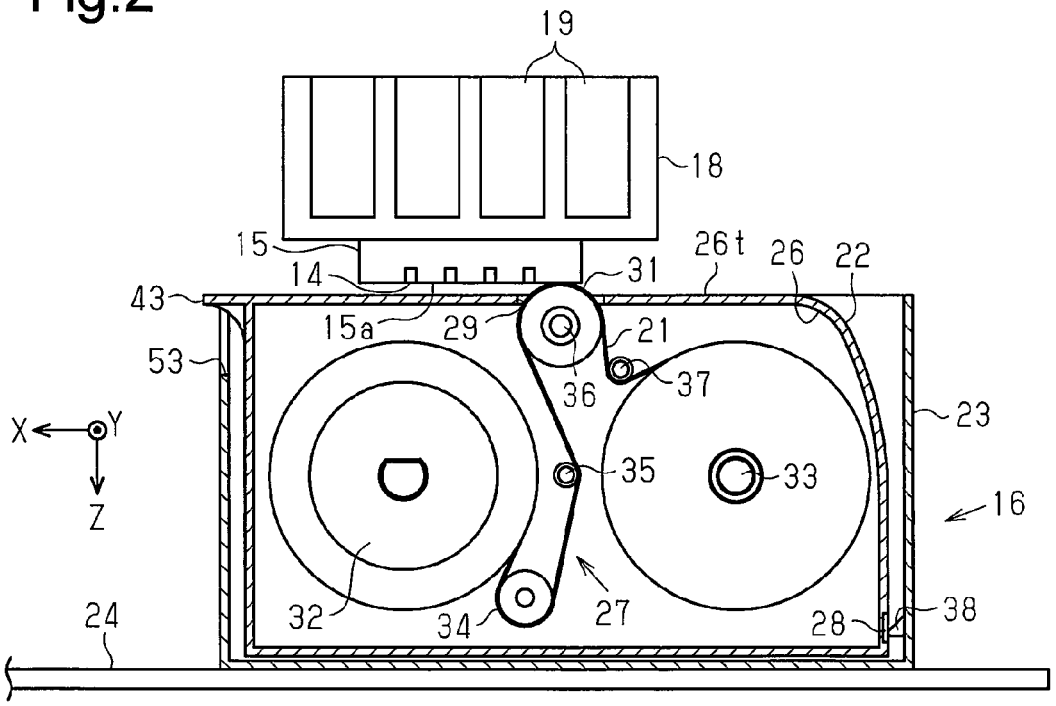
FIG. 2 is a schematic cross-sectional view showing one embodiment of a maintenance unit.

With reference to FIG. 2, the maintenance device 16 of the present embodiment performs a maintenance operation by wiping an opening surface 15*a*, in which the nozzles 14 of the liquid ejector 15 open, with an elongated maintenance member 21. The maintenance member 21, which is used to perform maintenance on the liquid ejector 15, is an absorption member capable of absorbing liquid and is preferably formed by, for example, a non-woven cloth impregnated in advance with a liquid used for maintenance. Preferably, a liquid repellent film is applied to the opening surface 15*a* of the liquid ejector 15 to limit collection or fixation of liquid.

The liquid impregnated in the absorption member is selected in accordance with the liquid ejected from the liquid ejector 15 and selected to improve or maintain the wiping characteristics. The liquid ejected by the liquid ejector 15 may be, for example, aqueous ink in which a coloring agent is added to a solvent of which the main component is water. Another example of the liquid is an organic solvent ink (non-water-based ink) in which a coloring agent is added to an organic solvent. Ink types include dye ink, which uses water-soluble dye as a coloring agent, and pigment ink, which uses pigment as a coloring agent. Another type of ink vaporizes a solvent of ink dropped onto a medium S so that the coloring agent of the ink stays on the medium S. There is also a type of ink which stays on the medium S by light irradiation such as UV light.

For example, when the liquid ejected by the liquid ejector 15 is pigment ink, it is preferred that the ink include a penetrant so that the absorbing member can easily absorb pigment particles and a humectant to limit evaporation of the impregnated liquid. In this case, the impregnated liquid in the absorbing member allows for smooth movement of the pigment particles from the surface of the absorbing member to the inner side of the absorbing member so that only a subtle amount of the pigment particles remain on the surface of the absorbing member.

Any of such impregnated liquid may be used as long as inorganic pigment particles are movable from the surface of the absorbing member to the inner side of the absorbing member. However, it is preferred that the surface tension of the impregnated liquid be 45 mN/m or less and further preferred that the surface tension be 35 mN/m or less. A low surface tension obtains satisfactory penetration of the inorganic pigment in the absorbing member and improves the wiping characteristics. To measure the surface tension, the Wilhelmy method may be conducted under a liquid temperature of 25° C. using a typical tensiometer, such as surface tensiometer CBVP-Z, which is manufactured by Kyowa Interface Science Co., Ltd.

The content amount of the impregnated liquid with respect to 100 mass % of the absorbing member is preferably 10 mass % or greater and 200 mass % or less, more preferably 10 mass % or greater and 120 mass % or less, and further preferably 30 mass % or greater and 100 mass % or less. When the content amount of the impregnated liquid with respect to 100 mass % of the absorbing member is 10 mass % or greater, inorganic pigment ink smoothly penetrates the absorbing member to the inner side. This limits scratching of the liquid repellant film on the opening surface 15*a* by the inorganic pigment, which has a high hardness. Further, when the content amount of the impregnated liquid with respect to 100 mass % of the absorbing member is 200 mass % or less, the residual impregnated liquid on the opening surface 15*a* may be further reduced. This reduces dot defects that would be caused when bubbles and the impregnated liquid enter the nozzles 14. This also reduces dot defects that would be caused when the impregnated liquid enters the nozzles 14.

Examples of additive agents that may be included in the impregnated liquid include a resin, a defoaming agent, a surfactant, water, or organic solvent, and a pH adjuster. One or more of these components may be added at any content amount.

The addition of a defoaming agent to the impregnated liquid as the additive agent effectively limits the formation of bubbles in the impregnated liquid remaining on the opening surface 15*a* subsequent to wiping. Further, the impregnated liquid may include a large amount of an acid humectant such as polyethylene glycol or glycerin. In this case, when a pH adjuster is used as the additive agent, the acid impregnated liquid does not come into contact with the ink composition (usually, base of pH 7.5 or greater). This limits shifting of the ink composition to the acid side and thus further sustains the preservation stability of the ink composition.

There is particularly no limitation to the humectant that may be included in the impregnated liquid as long as the humectant can be used for ink. For example, the humectant may have a boiling point under one atmosphere equivalent that is preferably 180° C. or higher and more preferably 200° C. or higher. When the boiling point of the humectant is as described above, the volatility of volatile components is reduced in the impregnated liquid. This ensures moistening of the ink components, which include inorganic pigment, in the contacted impregnated liquid. This allows wiping to be effectively performed.

Examples of humectants having a high boiling point include ethylene glycol, propylene glycol, diethylene glycol, triethylene glycol, pentamethylene glycol, trimethylene glycol, 2-butene-1,4-diol, 2-ethyl-1,3-hexane diol, 2-methyl-2,4-pentane diol, tripropylene glycol, polyethylene glycol, polypropylene glycol, 1,3-propylene glycol, isopropylene glycol, isobutylene glycol, glycerine, mesoerythritol, and pentaerythritol.

One of the above compounds or a mixture of two or more of the above compounds may be used as the humectant. The preferred content amount of the humectant with respect to the total mass of the impregnated liquid (100 mass %) is 10 mass % or greater and 100 mass % or less. All of the impregnated liquid is the humectant when the content amount of the humectant with respect to the total mass of the impregnated liquid is 100 mass %.

Among the additives that may be included in the impregnated liquid, the penetrant will now be described. There is particularly no limitation to the penetrant as long as the penetrant can be used for ink. In a solution in which 90 mass % is water and 10 mass % is the penetrant, the penetrant that is used may have a surface tension of 45 mN/m or less in the solution. Although not particularly limited, examples of the penetrant include one or more of compounds selected from a group consisting of an alkanediols having 5 to 8 carbons, glycol ethers, an acetylene glycol-based surfactant, a siloxane-based surfactant, and a fluorochemical surfactant. The surface tension may be measured through the method described above.

The content amount of the penetrant in the impregnated liquid is preferably 1 mass % or greater and 40 mass % or less, and more preferably 3 mass % or greater and 25 mass % or less. When the content amount of the penetrant in the impregnated liquid is 1 mass % or greater, superior wiping characteristics are obtained. When the content amount of the penetrant in the impregnated liquid is 40 mass % or less, it is avoided that the penetrant attacks the pigment in the ink near the nozzles. This avoids coagulation that would occur when the dispersion stability deteriorates.

Although not particularly limited, examples of alkanediols having 5 to 8 carbons include 1,2-pentane diol, 1,5-pentane diol, 1,2-hexane diol, 1,6-hexane diol, 1,2-heptane diol, 2-ethyl-1,3-hexane diol, 2,2-dimethyl-1,3-propane diol, and 2,2-dimethyl-1,3-hexane diol. One of the above compounds or a combination of two or more of the above compounds may be used as the alkanediols having 5 to 8 carbons.

Although not particularly limited, examples of glycol ethers include ethylene glycol mono-n-butyl ether, ethylene glycol mono-t-butyl ether, diethylene glycol mono-n-butyl ether, triethylene glycol mono-n-butyl ether, diethylene glycol mono-t-butyl ether, propylene glycol monomethyl ether, propylene glycol monoethyl ether, propylene glycol mono-t-butyl ether, propylene glycol mono-n-propyl ether, propylene glycol mono-iso-propyl ether, propylene glycol mono-n-butyl ether, dipropylene glycol mono-n-butyl ether, dipropylene glycol mono-n-propyl ether, dipropylene glycol mono-iso-propyl ether, diethylene glycol dimethyl ether, diethylene glycol diethyl ether, diethylene glycol dibutyl ether, diethylene glycol ethyl methyl ether, diethylene glycol butyl methyl ether, triethylene glycol dimethyl ether, tetraethylene glycol dimethyl ether, dipropylene glycol dimethyl ether, dipropylene glycol diethyl ether, tripropylene glycol dimethyl ether, ethylene glycol monoisohexyl ether, diethylene glycol monoisohexyl ether, triethylene glycol monoisohexyl ether, ethylene glycol monoisoheptyl ether, diethylene glycol monoisoheptyl ether, triethylene glycol monoisoheptyl ether, ethylene glycol monoisooctyl ether, diethylene glycol monoisooctyl ether, triethylene glycol monoisooctyl ether, ethylene glycol mono-2-ethyl hexyl ether, diethylene glycol mono-2-ethyl hexyl ether, triethylene glycol mono-2-ethyl hexyl ether, diethylene glycol mono-2-ethyl pentyl ether, ethylene glycol mono-2-ethyl pentyl ether, ethylene glycol mono-2-methyl pentyl ether, and diethylene glycol mono-2-methyl pentyl ether. One of the above compounds or a combination of two or more of the above compounds may be used as the glycol ethers.

Although not particularly limited, examples of an acetylene glycol-based surfactant include compounds represented by the formula shown below.

(1)

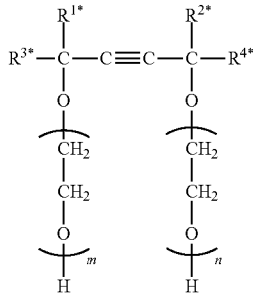

In formula (1), 0≤m+n≤50, R1*, R2*, R3*, and R4* each independently represent the alkyl group (preferably, alkyl group having 1 to 6 carbons).

Preferable examples of the acetylene glycol-based surfactant represented by formula (1) include 2,4,7,9-tetramethyl-5-decyne-4,7-diol, 3,6-dimethyl-4-octine-3,6-diol, and 3,5-dimethyl-1-hexyn-3-ol. Commercially available products may be used as the acetylene glycol-based surfactant represented by formula (1). Specific examples of an acetylene glycol-based surfactant include Surfynol 82, 104, 440, 465, 485, and TG (each available from AirProducts and Chemicals, Inc.) and Olfine STG and Olfine E1010 (trademarks, manufactured by Nissin Chemical Industry Co., Ltd.). One of the above products or a combination of two or more of the above products may be used as the acetylene glycol-based surfactant.

Although not particularly limited, examples of a siloxane-based surfactant include compounds represented by formula (2) or (3) shown below.

(2)

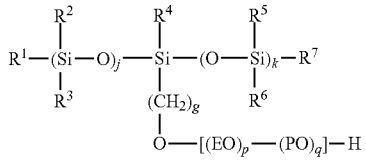

In formula (2), $R^1$, $R^2$, $R^3$, $R^4$, $R^5$, $R^6$, and $R^7$ each independently represent the alkyl group having 1 to 6 carbons, preferably, the methyl group. Further, j and K each independently represent an integer of 1 or greater and is preferably, 1 to 5, more preferably, 1 to 4, and further preferably, 1 or 2, where j=k=1 or k=j+1 is preferably satisfied. Here, g represents an integer of 0 or greater, preferably, 1 to 3, and more preferably 1. Moreover, p and q each represent an integer of 0 or greater, preferably, 1 to 5, where p+q is an integer of 1 or greater. Preferably, p+q is 2 to 4.

Preferably, the siloxane-based surfactant represented by formula (2) is a compound in which $R^1$ to $R^7$ each represent the methyl group, j represents 1 to 2, K represents 1 to 2, g represents 1 to 2, p represents an integer of 1 or greater and 5 or less, and q is 0.

(3)

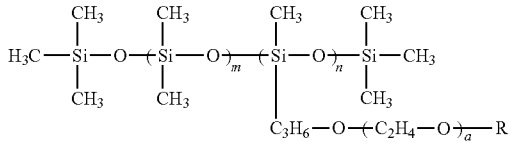

In formula (3), R represents a hydrogen atom or the methyl group, a represents an integer of 2 to 18, m represents an integer of 0 to 50, and n represents an integer of 1 to 5.

Although not limited, the siloxane-based surfactant represented by formula (3) is preferably, for example, a compound in which R represents a hydrogen atom or the methyl group, a represents an integer of 7 to 11, m represents an integer of 30 to 50, and n represents an integer of 3 to 5; a compound in which R represents a hydrogen atom or the methyl group, a represents an integer of 9 to 13, m represents an integer of 2 to 4 and n represents an integer of 1 to 2; a compound in which R represents a hydrogen atom or the methyl group, a represents an integer of 6 to 18, m represents an integer of 0 and n represents an integer of 1; or a compound in which R represents a hydrogen atom, a represents an integer of 2 to 5, m represents an integer of 20 to 40 and n represents an integer of 3 to 5.

Commercially available products may be used as the siloxane-based surfactant. Specific examples of a siloxane-based surfactant include, for example, Olfine PD-501 (manufactured by Nissin Chemical Industry Co., Ltd.), Olfine PD-570 (manufactured by Nissin Chemical Industry Co., Ltd.), BYK-347 (manufactured by BYK-Chemie Gmbh), and BYK-348 (manufactured by BYK-Chemie Gmbh). One of the above products or a combination of two or more of the above compounds may be used as the siloxane-based surfactant.

A fluorochemical surfactant is known as a solvent having satisfactory wetting characteristics with respect to a low-absorption or non-absorption recording medium as disclosed in WO2010/050618 and WO2011/007888. The fluorochemical surfactant is not particularly limited but may be selected in accordance with its purpose of use. Examples of a fluorochemical surfactant include perfluoroalkyl sulfonates, perfluoroalkyl carboxylates, perfluoroalkyl phosphate esters, perfluoroalkyl ethylene oxide adducts, perfluoroalkyl betaine, and perfluoroalkyl amine oxide compounds.

In addition to the above compounds, a properly synthesized product or a commercially available product may be used as the fluorochemical surfactant. Examples of a commercially available product include S-144 and S-145 (manufactured by Asahi Glass Co., Ltd); FC-170C, FC-430, and Fluorad FC-4430 (manufactured by Sumitomo 3M Limited); FSO, FSO-100, FSN, FSN-100, and FS-300 (manufactured by Dupont); and FT-250 and FT-251 (manufactured by Neos Corporation). Among these products, FSO, FSO-100, FSN, FSN-100, and FS-300, which are manufactured by Dupont are preferable. One of the above products or a combination of two or more of the above compounds may be used as the fluorochemical surfactant.

When the liquid ejected from the liquid ejector 15 is non-water-based ink, it is preferred that the impregnated ink that impregnates the absorbing member includes, for example, at least one type of an organic solvent (hereafter referred to as the specific organic solvent) selected from a group consisting a compound represented by general formula (I) shown below, esters, and dibasic acid esters. One of these specific solvents or a combination of two or more of these specific solvents may be included in the impregnated ink.

The specific solvent has a superior effect of dissolving (softening) the non-water-based ink collected on the opening surface 15*a*. This reduces coagulation of the components in the non-water-based ink and improves the wiping efficiency of the opening surface 15*a*.

$$R^1—O—(R^2—O)n\text{-}R^3 \quad (I)$$

In general formula (I), $R^1$ represents a hydrogen atom, an aryl group, or an alkyl group having 1 to 6 carbons. Further, $R^2$ represents an alkylene group having 2 to 4 carbons, $R^3$ represents an aryl group or an alkyl group having 1 to 6 carbons, and n represents an integer of 1 to 9. Example of an aryl group include a phenyl group, a benzyl group, a tolyl group, a xylyl group, a naphthyl group, a methyl naphthyl group, a benzyl phenyl group, and a biphenyl group. Examples of an alkyl group having 1 to 6 carbons, which may be a linear or branched alkyl group, include a methyl group, an ethyl group, an n-propyl group, an iso-propyl group, an n-butyl group, a sec-butyl group, a tert-butyl, a pentyl group, and a hexyl group. Examples of an alkylene group having 2 to 4 carbons include an ethylene group, an n-propylene group, an isopropylene group, and a butylene group.

Preferably, in general formula (I), $R^1$ represents a hydrogen atom or an alkyl group having 2 to 4 carbons. Further, in general formula (I), $R^3$ represents an alkyl group having 2 to 4 carbons. This improves the effect for dissolving (softening) the non-water-based ink and further increases the wiping efficiency.

Preferably, in general formula (I), n is an integer of 3 or greater and 6 or less. This improves the effect for dissolving (softening) the non-water-based ink and further increases the wiping efficiency.

Specific examples of compounds expressed by general formula (I) include alkylene glycol monoether and glycol ethers such as alkylene glycol diether. One of the above compounds or a combination of two or more of the above compounds may be used as the glycol ethers.

Examples of an alkylene glycol monoether include ethylene glycol monomethyl ether, ethylene glycol monoethyl ether, ethylene glycol monoisopropyl ether, ethylene glycol monobutyl ether, ethylene glycol monohexyl ether, ethylene glycol monophenyl ether, diethylene glycol monomethyl ether, diethylene glycol monoethyl ether, diethylene glycol monobutyl ether, diethylene glycol monohexyl ether, diethylene glycol monobenzyl ether, triethylene glycol monomethyl ether, triethylene glycol monoethyl ether, triethylene glycol monobutyl ether, tetraethylene glycol monomethyl ether, tetraethylene glycol monoethyl ether, tetraethylene glycol monobutyl ether, pentaethylene glycol monomethyl ether, pentaethylene glycol monoethyl ether, pentaethylene glycol monobutyl ether, propylene glycol monomethyl ether, propylene glycol monoethyl ether, dipropylene glycol monomethyl ether, and dipropylene glycol monoethyl ether.

Examples of alkylene glycol diether include ethylene glycol dimethyl ether, ethylene glycol diethyl ether, ethylene glycol dibutyl ether, diethylene glycol dimethyl ether, diethylene glycol diethyl ether, diethylene glycol ethyl methyl ether, diethylene glycol dibutyl ether, diethylene glycol butyl methyl ether, triethylene glycol dimethyl ether, triethylene glycol diethyl ether, triethylene glycol dibutyl ether, triethylene glycol butyl methyl ether, tetraethylene glycol dimethyl ether, tetraethylene glycol diethyl ether, tetraethylene glycol dibutyl ether, propylene glycol dimethyl ether, propylene glycol diethyl ether, dipropylene glycol dimethyl ether, and dipropylene glycol diethyl ether.

Examples of esters (R—CO—OR') may be an organic solvent in which R represents a hydrogen atom, an alkyl group, an aryl group, or a glycol ether group and R' represents an alkyl group or an aryl group. As such esters, it is preferred that glycol ether esters be used. Examples of glycol ether esters include ethylene glycol monomethyl ether acetate, ethylene glycol monoethyl ether acetate, ethylene glycol monopropyl ether acetate, ethylene glycol monobutyl ether acetate, propylene glycol monomethyl ether acetate, propylene glycol monoethyl ether acetate, propylene glycol monopropyl ether acetate, propylene glycol monobutyl ether acetate, dimethylene glycol monomethyl ether acetate, dimethylene glycol monoethyl ether acetate, dimethylene glycol monopropyl ether acetate, dimethylene glycol monobutyl ether acetate, diethylene glycol monomethyl ether acetate, diethylene glycol monoethyl ether acetate, diethylene glycol monopropyl ether acetate, diethylene glycol monobutyl ether acetate, dipropylene glycol monomethyl ether acetate, dipropylene glycol monoethyl ether acetate, dipropylene glycol monopropyl ether acetate, dipropylene glycol monobutyl ether acetate, trimethylene glycol monomethyl ether acetate, trimethylene glycol monoethyl ether acetate, trimethylene glycol monopropyl ether acetate, trimethylene glycol monobutyl ether acetate, triethylene glycol monomethyl ether acetate, triethylene glycol monoethyl ether acetate, triethylene glycol monopropyl ether acetate, triethylene glycol monobutyl ether acetate, tripropylene glycol monomethyl ether acetate, tripropylene glycol monoethyl ether acetate, tripropylene glycol monopropyl ether acetate, tripropylene glycol monobutyl ether acetate, 3-methoxy butyl acetate, and 3-methoxy-3-methyl-1-butyl acetate.

Examples of dibasic acid esters include a monoester or diester of dicarboxylic acid (such as aliphatic dicarboxylic acid including glutaric acid, adipic acid, and succinic acid). A specific example is dimethyl-2-methyl glutarate.

Among the specific organic solvents described above, it is preferred that a compound expressed by general formula (I) be used due to the superior effect for dissolving (softening) the non-water-based ink.

The specific organic solvent has a normal boiling point of preferably 170° C. or higher and more preferably 250° C. or higher. This reduces clogging of the nozzles 14 that occur when the impregnated liquid dries. Thus, satisfactory ejection stability may be obtained for the non-water-based ink.

The specific organic solvent has a vapor pressure at 20° C. that is preferably 1 hPa or less, more preferably 0.1 hPa or less, further preferably 0.5 hPa or less, and most preferably 0.01 hPa or less. This reduces clogging of the nozzles 14 that occur when the impregnated liquid dries. Thus, satisfactory ejection stability may be obtained for the non-water-based ink.

The specific organic solvent has a surface tension at 20° C. that is 25 mN/m or greater and 35 mN/m or less. This improves the compatibility with the non-water-based ink described below and further improves the wiping efficiency. The surface tension may be measured by using automatic surface tensiometer CBVP-Z (manufactured by Kyowa Interface Science Co., Ltd.) and checking the surface tension when wetting a platinum plate with the organic solvent under an environment of 20° C.

The content amount of the specific solvent with respect to the entire mass (100 mass %) of the impregnated liquid has a lower limit value that is preferably 30 mass % or greater and further preferably 50 mass % or greater. The wiping efficiency of the opening surface 15*a* further increases when the content amount of the specific organic solvent is 50 mass % or greater. The content amount of the specific solvent with respect to the entire mass (100 mass %) of the impregnated liquid may have any upper limit value such as 100 mass %.

When wiping is performed using an absorbing member holding the impregnated liquid, the impregnated liquid that impregnates the absorbing member includes the specific organic solvent at a content amount with respect to 100 parts by mass of the absorbing member that is preferably 10 parts by mass or greater, more preferably 15 parts by mass or greater, further preferably 20 parts by mass or greater, even more preferably 40 parts by mass or greater, and most preferably, 50 parts by mass or greater. The upper limit value is preferably 150 parts by mass or less and more preferably 100 parts by mass or less. When the solvent is 10 parts by mass or greater, the ink solidified on the opening surface 15*a* easily dissolves (softens). This further increases the wiping efficiency. When the solvent is 150 parts by mass or less, the absorbing member easily absorbs ink. This limits ejection failures and clogging of the nozzles 14 that would be caused by unwiped ink. Further, satisfactory ejection stability may be obtained for the ink.

The impregnated liquid that impregnates the absorbing member when the liquid ejected from the liquid ejector 15 is a solvent ink may include an organic solvent other than the specific organic solvents. Further, the impregnated liquid may include a substance that adds a certain property such as a surfactant, a pH adjuster, a chelator, a preservative, a fungicide, or a rust inhibitor.

As shown in FIG. 1, the maintenance device 16 includes a box-shaped mount 23 and a drive mechanism 25. A maintenance unit 22 (refer to FIG. 2), which includes a maintenance member 21, is mounted in a removable manner in the mount 23. The drive mechanism 25 moves the mount 23 back and forth along a guide frame 24 in the movement direction X.

As shown in FIG. 2, the maintenance unit 22 includes a holding structure 27, a case 26 and a memory 28. The holding structure 27 holds the maintenance member 21 in a movable manner inside the case 26. The case 26 accommodates the holding structure 27. The memory 28 stores information related to the maintenance member 21. The case 26 has a top surface 26*t* exposed to the liquid ejector 15 when the maintenance unit 22 is mounted in the mount 23.

A connection terminal 38, which is formed by a spring plate or the like, is arranged in the mount 23 at a location where the connection terminal 38 is able to contact a connection portion of the memory 28 when the maintenance unit 22 is mounted in the mount 23. The connection terminal 38 is electrically connected to the control unit 20 (refer to FIG. 1). Contact of the connection terminal 38 with the connection portion of the memory 28 when the maintenance unit 22 is mounted in the mount 23 allows the control unit 20 to write or read information to or from the memory 28 through the connection terminal 38.

The top surface 26*t* of the case 26 includes an opening 29. The maintenance member 21 is partially exposed through the opening 29. In the description hereafter, the portion of the maintenance member 21 that is exposed from the opening 29 is referred to as a wiping portion 31.

The holding structure 27 includes a supply reel 32, a take-up reel 33, and guide reels 34, 35, 36, and 37. The basal portion of the maintenance member 21 is wound around the supply reel 32. The distal portion of the maintenance member 21 is pulled out of the supply reel 32 and wound around the take-up reel 33. The maintenance unit 22 between the supply reel 32 and the take-up reel 33 runs along the guide reels 34, 35, 36, and 37. The guide reels 34, 35, 36, and 37 apply tension to the maintenance member 21 between the supply reel 32 and the take-up reel 33 and change the running direction of the maintenance member 21. The number and layout of the guide reels may be freely changed.

The guide reel 36 of the guide reels 34, 35, 36, and 37 partially projects out of the case 26 through the opening 29. Thus, the portion of the maintenance member 21 running along the guide reel 36 defines the wiping portion 31. Rotation of the supply reel 32 and the take-up reel 33 moves the maintenance member 21 and sequentially changes the wiping portion 31, which is arranged in the opening 29, to an unused portion.

Rotation of the supply reel 32 and the take-up reel 33 moves and consumes the maintenance member 21. When the maintenance member 21 can no longer be pulled out from the supply reel 32, the maintenance unit 22 is replaced by a new one. More specifically, the used maintenance unit 22 is removed from the mount 23, and a new maintenance unit 22 is mounted on the mount 23.

Figure 3:
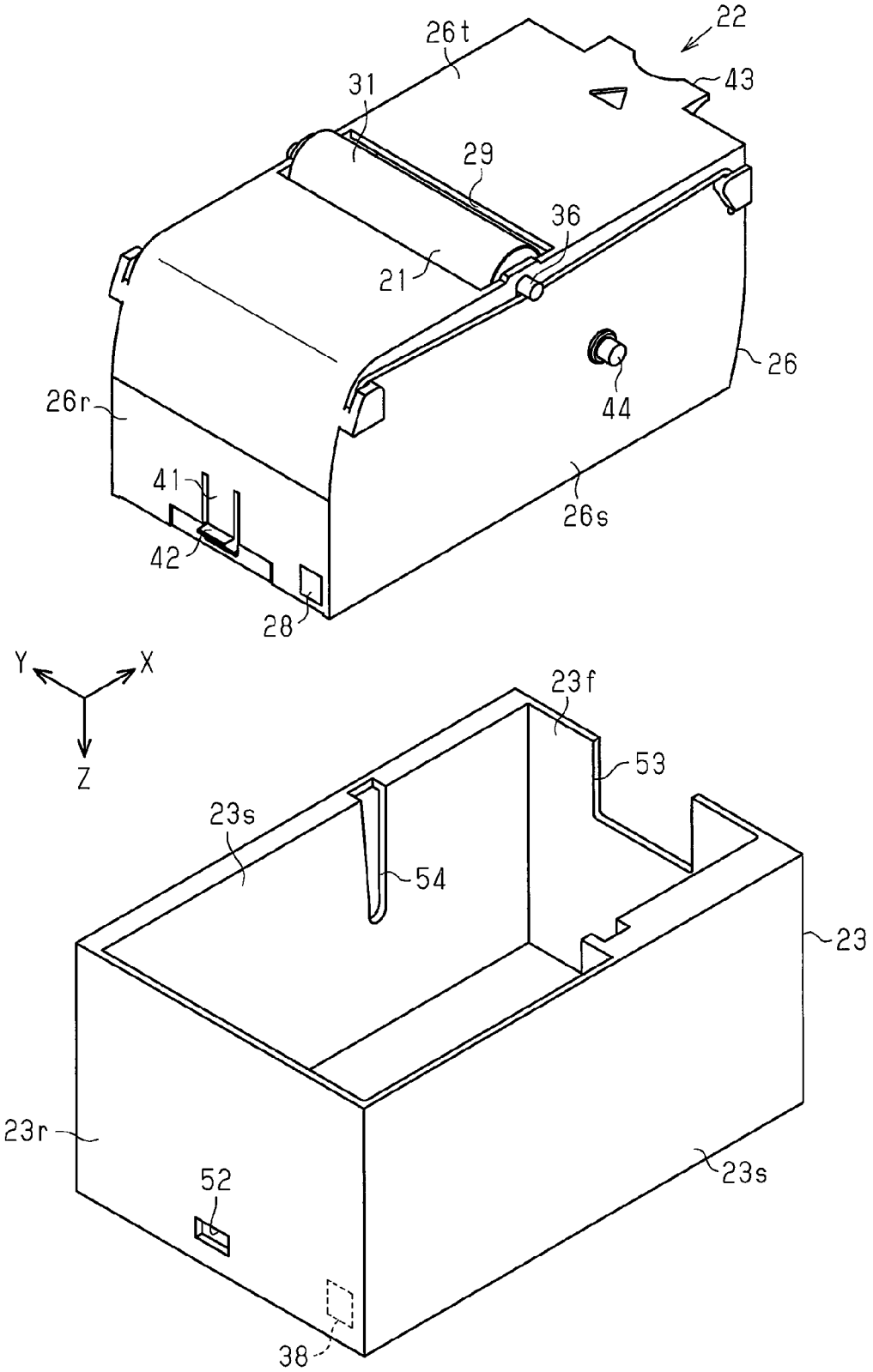
FIG. 3 is a perspective view showing the maintenance unit, which is mounted on a mount, from one direction.
Figure 4:
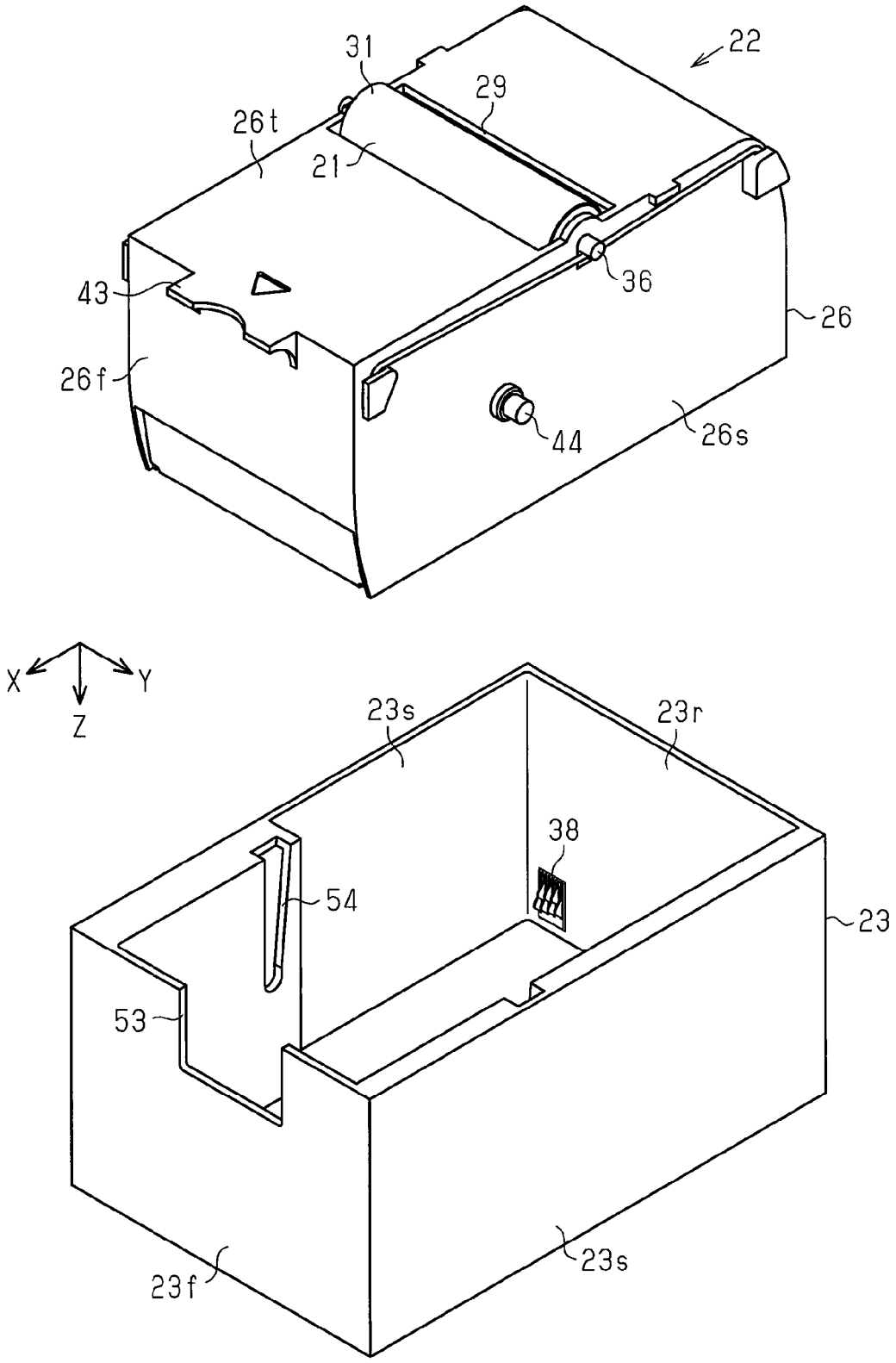
FIG. 4 is a perspective view showing the maintenance unit, which is mounted on the mount, from another direction.

As shown in FIGS. 3 and 4, the longitudinal direction of the case 26 in the maintenance unit 22 extends in the movement direction X. The longitudinal direction of the wiping portion 31 and the opening 29, which are located around the longitudinally middle part of the case 26, extends in the feed direction Y.

In the present embodiment, one longitudinal side of the case 26 extending from the opening 29 (side including triangular mark on top surface 26*t*) is referred to as the distal side. The other longitudinal side of the case 26 extending in the opposite direction from the opening 29 (side where top surface 26*t* is curved) is referred to as the basal side. The case 26 includes a distal surface 26*f*, which intersects the top surface 26*t*, a basal surface 26*r*, which intersects the top surface 26*t*, and side surfaces 26*s*, which intersect the top surface 26*t*, the distal surface 26*f*, and the basal surface 26*r*.

When the mount 23 receives the maintenance unit 22, the mount 23 has a front wall 23*f* that opposes the distal surface 26*f*, a rear wall 23*r* that opposes the basal surface 26*r*, and side walls 23*s* opposed to the side surfaces 26*s*.

The basal surface 26*r* of the case 26 has a lower portion that includes a resilient piece 41. The upper side of the resilient piece 41 includes an end fixed to the case 26, and the lower side of the resilient piece 41 includes a free end. The resilient piece 41 is resiliently deformable in the movement direction X about the upper fixed end. A hook 42 outwardly extends from the lower free end of the resilient piece 41.

The rear wall 23*r* of the mount 23 has a lower portion that includes a hook hole 52 that can be engaged with the hook 42 of the resilient piece 41. When the maintenance unit 22 is mounted in the mount 23, the hook 42 of the maintenance unit 22 is engaged with the hook hole 52 of the mount 23. This restricts separation of the maintenance unit 22 from the mount 23.

The upper end of the distal surface 26*f* of the case 26 includes a tab 43. The tab 43 projects from the top surface 26*t* in a direction extending from the basal end toward the distal end. A user may use the tab 43 to remove the maintenance unit 22 from the mount 23.

The upper end of the front wall 23*f* of the mount 23 includes a slot 53. When the maintenance unit 22 is mounted in the mount 23, the tab 43 of the maintenance unit 22 is exposed to the outer side of the mount 23 through the slot 53 (refer to FIG. 2).

The two side surfaces 26*s* of the case 26 each include a cylindrical projection 44. The projection 44 is located slightly toward the distal side from the longitudinally middle part of the corresponding side surface 26*s*. The projection 44 is also located around the middle part of the corresponding side surface 26*s* in the vertical direction (ejection direction Z).

The inner portion of each side wall 23*s* of the mount 23 includes a guide groove 54 that downwardly extends from the upper end to around the vertically middle part at a position located slightly toward the distal end from the longitudinally middle part. Preferably, the open upper end of the guide groove 54 has a width that is set to be slightly greater than the diameter of the projections 44. The width gradually decreases toward the lower side. When mounting the maintenance unit 22 in the mount 23, the guide grooves 54 guide the projections 44 of the maintenance unit 22 so that the maintenance unit 22 is properly positioned in the mount 23.

Wiping, which is a maintenance operation performed by the maintenance device 16, will now be described.

When the liquid ejection device 11 ejects droplets of a specified size from the nozzles 14 to perform printing, a mist of fine droplets, which are smaller than the ejected droplets, is produced as a by-product. The mist collects around the nozzles 14 and gradually grows into droplets. The grown droplets may contact the droplets ejected from the nozzles 14 and change the flight direction of the ejected droplets. This may lower the printing quality.

Thus, when printing has been performed a predetermined number of times or over a predetermined time, the carriage 18 moves to a maintenance region, and the maintenance device 16 performs wiping with the maintenance member 21. More specifically, the drive mechanism 25 drives and moves the mount 23, in which the maintenance unit 22 is mounted, in the movement direction X to wipe the opening surface 15*a* of the liquid ejector 15 with the wiping portion 31 (refer to FIG. 2).

In the liquid ejection device 11, when the carriage 18 moves to the maintenance region and performs a discharge operation that discharges liquid from the nozzles 14 of the liquid ejector 15 as a maintenance operation, the liquid discharged from the nozzles 14 may collect on the opening surface 15*a*. The maintenance device 16 also performs wiping in such a case with the maintenance member 21.

As a result, the maintenance member 21 absorbs the mist collected on the liquid ejector 15 and the liquid collected on the opening surface 15*a*. The maintenance member 21 also wipes off foreign matter, such as paper particles, from the liquid ejector 15. When wiping of the liquid ejector 15 ends, the supply reel 32 and the take-up reel 33 are rotated to move the maintenance member 21 and change the wiping portion 31 exposed from the opening 29 to an unused portion.

When the mount 23 is moved in the movement direction X and the wiping portion 31 is in contact with the liquid ejector 15, the wiping characteristics of the wiping portion 31 may be improved by rotating the supply reel 32 and the take-up reel 33 and moving the maintenance member 21.

The information stored in the memory 28 will now be described.

The memory 28 stores at least one of the information listed below.

(1) A value corresponding to the number of times maintenance has been performed with the maintenance member 21.

(2) A value corresponding to the amount the maintenance member 21 has been moved to perform maintenance on the liquid ejector 15.

(3) Information related to the liquid ejection device in which the maintenance unit 22 is mounted.

(4) Information related to the date the maintenance unit 22 was mounted in the liquid ejection device.

(5) Information related to the manufacturing date of the maintenance unit 22.

(6) Information related to applicable liquid ejection devices of the maintenance unit 22.

(7) Information related to the liquid the maintenance member 21 is impregnated with.

Each of the above information will now be described.

Information (1) is related to the usage history of the maintenance member 21 and is, for example, the cumulative value of the number of times wiping has been performed. Alternatively, when a usage number limit, which is the number of times the maintenance unit 22 can perform maintenance until becoming unusable, is set for the maintenance unit 22, information (1) may be the ratio of the number of times maintenance has been performed relative to the usage number limit, or the remaining number of times maintenance can be performed before reaching the usage number limit.

Information (2) is related to the usage history of the maintenance member 21 and is, for example, the cumulative value of the number of times the maintenance member 21 has been moved to perform wiping, the cumulative value of the rotated amount of the supply reel 32 or the take-up reel 33, or the cumulative value of the length of the maintenance member 21 that has passed by a predetermined measurement position. Alternatively, information (2) may be the ratio of the moved amount of the maintenance member 21 relative to the entire length of the maintenance member 21, the remaining length of the unused portion, or the ratio of the remaining length of the unused portion relative to the entire length of the maintenance member 21.

Information (3) is related to the usage history of the maintenance member 21, and is preferably stored in the memory 28, particularly, when the same maintenance unit 22 is used for a number of different liquid ejection devices. Whenever the same maintenance unit 22 is mounted on a liquid ejection device, the memory 28 stores information specifying the type of the liquid ejection device and the type of the liquid ejected by the liquid ejection device as information related to the liquid ejection device in which the maintenance unit 22 is mounted.

Information (4) is related to the usage history of the maintenance member 21 and may be, for example, the date the maintenance unit 22 was mounted in the liquid ejection device for the first time. Alternatively, when an expiration date is set for the use of the maintenance unit 22, information (4) may be the remaining number of days until the expiration date, which is set based on the date the maintenance unit 22 was first mounted in the liquid ejection device.

Information (5) may be the manufacturing date of the maintenance unit 22. When an expiration date is set for the use of the maintenance unit 22, information (5) may be the remaining number of days until the expiration date, which is set based on the manufacturing date.

Information (6) is preferably stored in the memory 28 as the type of the ejected liquid, the type of the impregnated liquid, and the type of the liquid ejection device particularly when the maintenance unit 22 cannot be used for certain liquid ejectors due to the material of the maintenance member 21 or the impregnated liquid of the maintenance member 21, which functions as the absorbing member.

In particular, the selected impregnated liquid has characteristics that are suitable for the liquid ejected from the liquid ejector 15. Thus, it is not preferable when such an impregnated liquid is used for a liquid ejector 15 that ejects a different type of liquid. For example, the optimal composition of the impregnated liquid is selected for the composition of the used ink. Thus, when a maintenance member 21 having a usage history applies the impregnated liquid to a liquid ejector 15 using ink that is non-compatible with the impregnated liquid, depositions of foreign matter may be produced from the ink that contacts the impregnated liquid.

In such a case, the deposited foreign matter becomes fixed to the opening surface 15*a*. This may obstruct wiping of the opening surface 15*a* such that the foreign matter cannot be removed or such that the liquid repellent film on the opening surface 15*a* is scratched. In particular, the pigment used in pigment ink is stably dispersed by the solvent (water-based or organic). Thus, when the pigment is mixed with a different type of solvent, there is a tendency of foreign matter being produced from the ink due to the deposition or solidification of the pigment.

Information (7) is preferably stored in the memory 28 as the impregnated liquid of the maintenance member 21 like information (6) when the impregnated liquid is not suitable for use in certain liquid ejectors 15. When an expiration date or a usage number limit is set for the maintenance unit 22 based on the evaporation rate of the impregnated liquid of the maintenance member 21 or the rate of change of the characteristics of the impregnated liquid, the memory 28 may store the remaining days until the expiration date or the remaining number of times the maintenance unit 22 can be used. When the maintenance member 21 is not impregnated with liquid, the memory 28 may store information indicating that the maintenance member is not impregnated with liquid as the information impregnated related to the liquid the maintenance member is impregnated with.

The control executed by the control unit 20 on the maintenance device 16 will now be described.

The control unit 20 controls the maintenance device 16 and the like based on the various information stored in the memory 28 of the maintenance unit 22.

When, for example, the maintenance unit 22 is mounted in the mount 23, the control unit 20 reads information (1) to (7) from the memory 28, which is connected to the connection terminal 38. When the expiration date related to the mounting date of information (4) or to the manufacturing date of information (5) has elapsed, when the type of liquid ejection device 11 is not included in the applicable liquid ejection devices indicated in information (6), or when the type of liquid ejection device 11 is not suitable for the impregnated liquid indicated in information (7), the display unit 55 shows a message indicating such a situation to notify the user.

Based on information (1) and (2), the control unit 20 acknowledges the remaining number of times the maintenance unit 22 may be used before reaching the usage number limit and the length of the non-used portion of the maintenance member 21. When the remaining number of times before reaching the usage number limit is zero or when the remaining length of the unused portion of the maintenance member 21 is not enough for performing a single wiping, the control unit 20 indicates an error on the display unit 55.

After a maintenance operation is performed, the remaining number of times maintenance can be performed before reaching the usage number limit may be close to zero or the remaining length of the unused portion of the maintenance member 21 may be insufficient. In such a case, a warning may be shown on the display unit 55. Further, if the maintenance unit 22 mounted in the mount 23 reaches the expiration date or usage number limit, it is preferable that a message indicating such a situation be shown on the display unit 55 to notify the user.

The control unit 20 writes the information of the liquid ejection device 11 in which the maintenance unit 22 is actually mounted as information (3) to the memory 28 connected to the connection terminal 38. When information (3) has already been written to the memory 28, the control unit 20 reads the information. If the liquid ejection device 11 in which the maintenance unit 22 is presently mounted is not compatible with the liquid ejection device in which the maintenance unit 22 was mounted in the past, the control unit 20 shows an error message on the display unit 55.

Based on information (1) to (7), when the control unit 20 determines that the next wiping can be performed, the control unit 20 allows the maintenance device 16 to perform a maintenance operation. When the maintenance device 16 performs wiping, the number of times wiping has been performed and the amount that has been used for wiping is stored in the memory 28.

The operation of the liquid ejection device 11 will now be described.

For example, the control unit 20 may perform wiping for a number of times between consecutively performed printing processes. However, the printing process would be interrupted if the usage number limit for wiping is reached during the consecutive printing processes. Thus, the control unit 20 checks information (1), which is stored in the memory 28, before performing a maintenance operation to avoid such a situation.

The control unit 20 may perform wiping by moving the maintenance member 21. However, the maintenance member 21 may run out of unused portions during the wiping. Thus, the control unit 20 checks information (2), which is stored in the memory 28, before performing a maintenance operation to avoid such a situation.

After performing a maintenance operation, when the remaining number of times before reaching the usage number limit is close to zero or the remaining length of the unused portion of the maintenance member 21 is insufficient, the control unit 20 shows a warning on the display unit 55. This allows the user to prepare the next maintenance unit 22 at an appropriate timing. For example, if the remainder of the maintenance member 21 is small when continuously performing a printing process over a long time, the maintenance unit 22 may be exchanged with one having a large remainder. When performing a short printing process, a maintenance unit 22 having a small remainder may be mounted and used until it runs out.

Before performing a maintenance operation, the control unit 20 checks information (4) and (5), which are stored in the memory 28, so as not to wipe the liquid ejector 15 with a maintenance member 21 of which the expiration date has elapsed and to avoid a situation in which wiping of the liquid ejector 15 is not properly performed.

Before performing a maintenance operation, the control unit 20 checks information (3), (6), and (7), which are stored in the memory 28, to avoid a situation in which ejection liquid or impregnated liquid that is not suitable for the liquid ejector 15 collects on the liquid ejector 15 and adversely affect the characteristics of the liquid ejected from the nozzles 14.

The above embodiment has the advantages described below.

(1) The memory 28 of the maintenance unit 22 stores information related to the maintenance member 21. This allows for proper management of the maintenance member 21, which is used to perform maintenance on the liquid ejector 15, based on the information stored in the memory 28.

(2) The used amount of the maintenance member 21 is estimated based on the value corresponding to the number of times maintenance is performed and stored in the memory 28. This allows maintenance to be properly performed on the liquid ejector 15 while managing the remainder of the maintenance member 21.

(3) The used amount of the maintenance member 21 is estimated based on the value corresponding to the moved amount of the maintenance member 21 and stored in the memory 28. Thus, even when, for example, a maintenance unit 22, which is being used, is mounted in a different liquid ejection device 11, cumulation of the used amount of the maintenance member 21 allows for accurate management of the remainder of the maintenance member 21.

(4) The memory 28 stores information related to the liquid ejection device in which the maintenance unit 22 is mounted. Thus, even when, for example, a maintenance unit 22, which is being used, is mounted in a different liquid ejection device, it would be acknowledged whether or not the maintenance unit 22 has ever been mounted in that liquid ejection device.

(5) The memory 28 stores information related to the date the maintenance unit 22 was mounted in the liquid ejection device. Thus, when there is an expiration date for the use of the maintenance member 21, the expiration date may be managed and maintenance may be properly performed on the liquid ejector 15.

(6) The memory 28 stores information related to the manufacturing date of the maintenance unit 22. Thus, when there is an expiration date for the use of the maintenance member 21, the expiration date may be managed and maintenance may be properly performed on the liquid ejector 15.

(7) When there is a maintenance member 21 that is suitable for use with a certain liquid ejector 15 and a maintenance member 21 that is not suitable for use with the certain liquid ejector 15, the information stored in the memory 28 and related to the liquid ejection devices in which the maintenance unit 22 is mountable may be referred to in order to avoid a situation in which maintenance is performed on the liquid ejector 15 with an unsuitable maintenance member 21.

(8) When there is an impregnated liquid that is suitable for use with a certain liquid ejector 15 and an impregnated liquid that is not suitable for use with the certain liquid ejector 15, the information stored in the memory 28 and related to the impregnated liquid of the maintenance member 21 may be referred to in order to avoid a situation in which a maintenance member 21 impregnated with the unsuitable liquid performs maintenance on the liquid ejector 15.

It should be apparent to those skilled in the art that the present invention may be embodied in many other specific forms without departing from the spirit or scope of the invention. Particularly, it should be understood that the present invention may be embodied in the following forms.

The maintenance member 21 used for maintenance of the liquid ejector 15 does not have to be impregnated with maintenance liquid in advance. The maintenance member 21 may be impregnated with maintenance liquid, which is supplied from a separate maintenance liquid supply unit in the maintenance unit 22, before performing wiping with the maintenance member 21.

Figure 5:
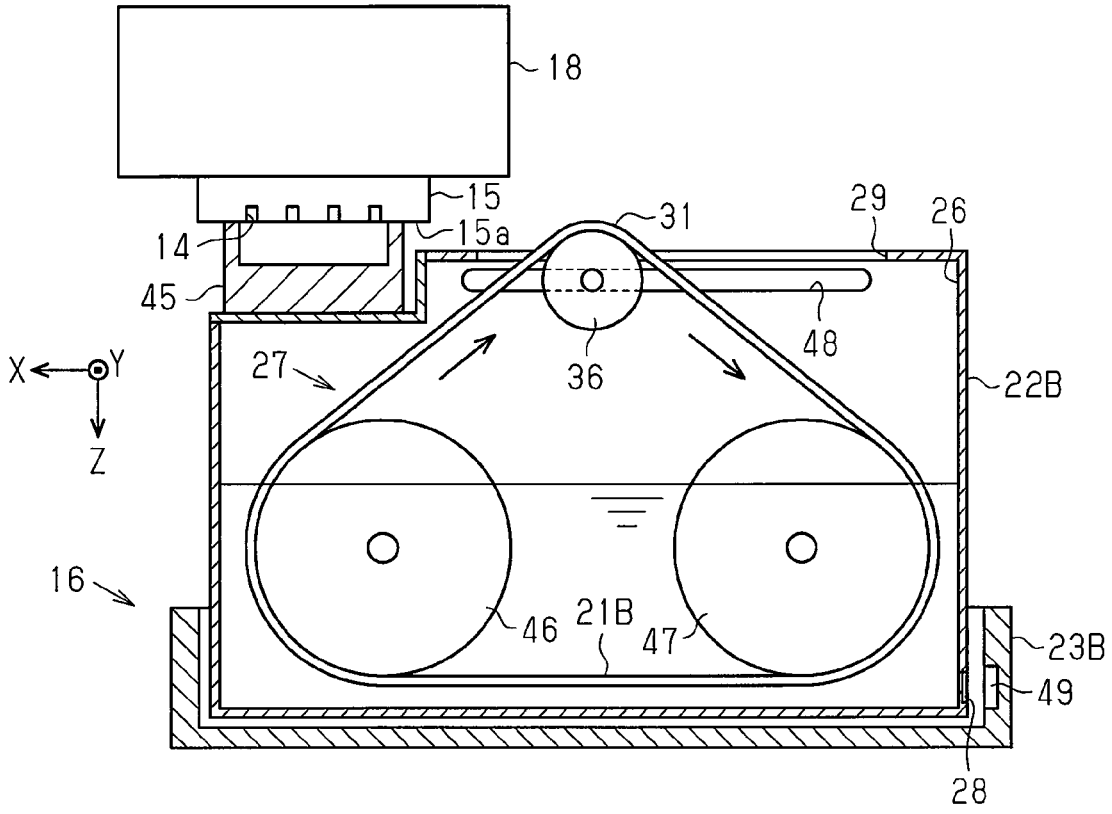
FIG. 5 is a cross-sectional view showing a modified example of the maintenance unit and the mount.

As shown in FIG. 5, a maintenance unit 22B, which is capable of performing maintenance operations including capping and flashing in addition to wiping, may be mounted in a mount 23B. More specifically, the maintenance unit 22B includes a cap 45 that is arranged next to the wiping portion 31 in the movement direction X. The cap 45 contacts the liquid ejector 15 so as to surround the nozzles 14 of the liquid ejector 15 and seal the area in which the nozzles 14 open. This hinders drying of the nozzles 14.

Further, the case 26 of the maintenance unit 22B includes a large opening 29 capable of receiving the droplets ejected from the nozzles 14. The liquid ejector 15 ejects liquid droplets toward the opening 29 to perform flashing that discharges foreign matter from the nozzles 14. The liquid ejected during the flashing may be received, for example, by a portion of the maintenance member 21 located at the downstream side of the wiping portion 31 (portion that has been used for wiping), which is moved in one direction as indicated by the arrows in FIG. 5.

As shown in FIG. 5, the maintenance member 21B may be endless. In this case, the endless maintenance member 21B, which runs along belt reels 46 and 47, is moved by the rotation of the belt reels 46 and 47.

Further, the case 26 of the maintenance unit 22B may contain liquid in which the maintenance member 21B is partially immersed. In this case, the liquid washes the maintenance member 21B and removes pigment and foreign matter from the maintenance member 21B. This allows the maintenance member 21B to be repetitively reused. When employing this structure, it is preferred that the expiration date or usage number limit of the maintenance unit 22B be set based on the evaporation rate of the liquid in the case 26 or how easily the characteristics of the liquid changes.

Referring to FIG. 5, the mount 23B may be fixed. In this case, for example, the guide reel 36, which projects from the opening 29, is moved along a guide hole 48, which extends in the movement direction X, to wipe the liquid ejector 15, which is stopped in the maintenance region. Alternatively, instead of moving the guide reel 36, the liquid ejector 15 may be moved relative to the wiping portion 31 in the movement direction X to wipe the liquid ejector 15.

As shown in FIG. 5, the mount 23B need not have a size (height) that allows for the maintenance unit 22 to be entirely accommodated.

As shown in FIG. 5, the mount 23B may include a communication unit 49 that transmits and receives data through wireless communication. The communication unit 49 may be used to write and read data to and from the memory 28 of the maintenance unit 22B.

Referring to FIG. 5, the liquid containers 19 may be omitted from the carriage 18, and the liquid ejector 15 may be supplied with liquid through liquid tubes (not shown) located inside or outside the housing 12. That is, the liquid containers 19 that contain the liquid supplied to the liquid ejector 15 do not have to be of an on-carriage type, mounted in a removable manner on the carriage 18, and may be of an off-carriage type, fixed at a predetermined location separated from the carriage 18 in the housing 12.

The mount 23 may be moved in the feed direction Y so that the wiping portion 31 wipes the liquid ejector 15.

In addition to showing information on the display unit 55, the notification provided to the user may be a buzzing noise or a voice guide. Further, the notification may be generated by activating, intermittently activating, or deactivating a lamp.

The remaining number of times the maintenance unit 22 can be used before reaching the usage number limit, the remaining length of the unused portion of the maintenance member 21, or the remaining days until the usage expiration date may be shown on the display unit 55. In such a configuration, the user may refer to the remaining number of times and prepare the next maintenance unit 22 at an appropriate timing.

The liquid ejected by the liquid ejector 15 is not limited to ink and may be, for example, in a liquid form obtained by dispersing or mixing particles of functional material in a liquid. For example, the liquid ejector 15 may be configured to perform recording by ejecting a liquid form including dispersed or dissolved material such as electrode material or color material (pixel material) used to manufacture a liquid crystal display, an electroluminescence (EL) display, or a planar light-emitting display.

The liquid ejection device may be changed to a full-line type that does not include the carriage 18 but includes a fixed liquid ejector 15 elongated in conformance with the entire width of the medium S. In this case, the liquid ejector 15 may include head units provided with the nozzles 14 and arranged next to one another so that the printing range extends over the entire width of the medium S. Alternatively, the liquid ejector 15 may include a single elongated head provided with the nozzles 14 and arranged so that the printing range extends over the entire width of the medium S.

The liquid container 19 may have a structure in which a flexible package containing liquid is accommodated in a rigid case or a structure in which liquid is contained directly in a rigid case.

The liquid container 19 may include an inlet used when filling the liquid container 19 with liquid or when adding liquid. This allows liquid to be added without removing the liquid container 19.

The medium is not limited to paper and may be a plastic film, a thin plate, or a fabric used for textile printing devices.

The present examples and embodiments are to be considered as illustrative and not restrictive, and the invention is not to be limited to the details given herein, but may be modified within the scope and equivalence of the appended claims.

What is claimed is:

1. A maintenance unit mounted in a removable manner in a mount of a liquid ejection device including a liquid ejector that ejects liquid, the maintenance unit comprising:

an elongated maintenance member used to perform maintenance on the liquid ejector;

a holding structure that holds the maintenance member;

a case configured to receive the holding structure; and a memory configured to store information related to the maintenance member.

2. The maintenance unit according to claim 1, wherein the memory is configured to store a value corresponding to the number of times maintenance has been performed with the maintenance member.

3. The maintenance unit according to claim 1, wherein the memory is configured to store a value corresponding to an amount the maintenance member has been moved to perform maintenance on the liquid ejector.

4. The maintenance unit according to claim 1, wherein the memory is configured to store information related to the liquid ejection device in which the maintenance unit has been mounted.

5. The maintenance unit according to claim 1, wherein the memory is configured to store information related to a date the maintenance unit was mounted in the liquid ejection device.

6. The maintenance unit according to claim 1, wherein the memory is configured to store information related to a manufacturing date of the maintenance unit.

7. The maintenance unit according to claim 1, wherein the memory is configured to store information related to the liquid ejection device in which the maintenance unit is mountable.

8. The maintenance unit according to claim 1, wherein the memory is configured to store information related to liquid with which the maintenance unit is impregnated.

9. A liquid ejection device comprising:

a liquid ejector that ejects liquid;

the mount in which the maintenance unit according to claim 1 is mounted in a removable manner to perform maintenance on the liquid ejector; and a control unit configured to perform a maintenance operation on the liquid ejector based on information stored in the maintenance unit.

10. The maintenance unit according to claim 1, wherein the case is removably mounted to the liquid ejection device and supports at least a portion of the maintenance member and the memory so that the memory is connected to a connection terminal arranged within the mount when the case is received within the mount.

11. The maintenance unit according to claim 1, further comprising:

the holding structure includes a guide reel that holds a portion of the maintenance member, the portion being in contact with the liquid ejector in the maintenance, wherein the memory is located at a lower position than the guide reel when the case is received within the mount.

12. The maintenance unit according to claim 11, wherein the case includes a surface having the memory and a bottom surface in a state where the case is received within the mount, wherein the memory is located at a position closer to the bottom surface from the portion of the maintenance member in a direction of gravity in the state where the case is received within the mount.

* * * * *